United States Patent [19]

Kubomoto

[11] Patent Number: 4,986,072

[45] Date of Patent: Jan. 22, 1991

[54] HYDRAULIC ACTUATOR CIRCUIT WITH FLOW-JOINING CONTROL

[75] Inventor: Wataru Kubomoto, Hiroshima, Japan

[73] Assignee: Kabushiki Kaisha Kobe Seiko Sho, Kobe, Japan

[21] Appl. No.: 400,928

[22] Filed: Aug. 31, 1989

[51] Int. Cl.[5] ..... F15B 13/04

[52] U.S. Cl. ..... 60/421; 60/430; 91/28

[58] Field of Search ..... 91/24, 29, 28, 510, 91/518; 60/430, 421

[56] References Cited

U.S. PATENT DOCUMENTS 4,141,280 2/1979 Lorimor ..... 91/29
4,164,119 8/1979 Parquet ..... 60/430 X
4,875,337 10/1989 Sugiyama et al. ..... 91/531 X

FOREIGN PATENT DOCUMENTS 90702 7/1980 Japan ..... 91/29

*Primary Examiner*—Edward K. Look
*Assistant Examiner*—George Kapsalas
*Attorney, Agent, or Firm*—Oblon, Spivak, McClelland, Maier & Neustadt

[57] ABSTRACT

A hydraulic actuator control circuit capable of increasing the flow rate of the working fluid supplied to hydraulic actuators when the load on the hydraulic actuators increases beyond predetermined values includes a first valve group having a plurality of pilot controlled selector valves connected, respectively, to hydraulic actuators, a second valve group having a plurality of pilot controlled selector valves connected, respectively, to lines connecting the hydraulic actuators to the pilot controlled selector valves of the first valve group, two hydraulic pumps connected, respectively, to the first and second valve groups, and a tank for containing working fluid. A two-port two-position valve and a pilot controlled selector valve for applying a pilot pressure to the pilot chamber of the two-port two-position valve are controlled according to the load on the a logic so that the hydraulic selector valve of the second valve group is connected to the hydraulic actuator in addition to the hydraulic selector valve of the first valve group to increase the flow rate of the working fluid supplied to the hydraulic actuator when the load on the hydraulic actuator exceeds a predetermined value, to operate the hydraulic actuator at an increased operating speed.

4 Claims, 3 Drawing Sheets

HYDRAULIC ACTUATOR CIRCUIT WITH FLOW-JOINING CONTROL

BACKGROUND OF THE INVENTION

1. Field of the Invention

The present invention relates to a hydraulic actuator control circuit for controlling the operation of a single hydraulic actuator by controlling a hydraulic circuit including the hydraulic actuator and a plurality of valve groups, each formed of a plurality of selector valves, in which the working fluid supplied through one of a plurality of selector valves of one of a plurality of valve groups, each of a plurality of selector valves and the working fluid supplied to another valve group are supplied together to the hydraulic actuator.

2. Description of the Conventional Art

A conventional hydraulic actuator control method increases the operating speed of a hydraulic actuator by controlling a hydraulic circuit so that the working fluid discharged from one of the hydraulic pumps is supplied to one of two individual valve groups of selector valves and the working fluid discharged from the other hydraulic pump to the other valve group of selector valves, and simultaneously controlling the selector valves of the two valve groups of selector valves to supply all the working fluid discharged from the two hydraulic pumps is supplied to the hydraulic actuator.

Another conventional hydraulic actuator control method increases the operating speed of a hydraulic actuator by simultaneously supplying the working fluid delivered from one of the selector valves of one of two valve groups and the working fluid delivered from one of the selector valves of the other valve group so that the working fluid is supplied at an increased rate to the hydraulic actuator to increase the operating speed of the hydraulic actuator.

FIG. 2 shows a hydraulic circuit employing a logic valve for increasing the operating speed of a hydraulic actuator for operating the arm of a hydraulic shovel excavator.

Referring to FIG. 2, a first hydraulic pump 2, a second hydraulic pump 3 and a pilot pump 4 are driven by an engine 1 to discharge working fluid sucked up from a tank 19 at appropriate pressures limited by relief valves. The first hydraulic pump 2 is connected by a line 5 to a valve group A comprising selector valves 8, 9, 10 and 11. The second hydraulic pump 3 is connected by a line 6 to a valve group B comprising selector valves 12, 13 and 14. The pilot pump 4 is connected by a line 7 to a control system including a pilot valve 16. Indicated at 17 is a hydraulic actuator for operating the arm. When the pilot valve 16 is operated to apply a signal pressure to the side E of the selector valve 11, and the pilot chambers of shutoff valves 15 and 25, the selector valve 11 is shifted to the side E, the shutoff valve 25 connects the chamber of a logic valve 18 to the tank 19, and the shutoff valve 15 shuts-off the central bypass line 32 of the valve group B. Consequently, the working fluid supplied to the valve group A by the first hydraulic pump 2 flows through a line 20 into the head-side chamber of the hydraulic actuator and, at the same time, the working fluid supplied to the valve group B by second hydraulic pump 3 flows through the logic valve 18 and a line 22 and the line 20 into the head-side chamber of the hydraulic actuator 17 to actuate the hydraulic actuator 17.

When this hydraulic system including the above hydraulic circuit and the hydraulic actuator 17 is used for elaborately operating the arm b of a hydraulic shovel excavator as shown in FIG. 3 in finishing a side slope d or light digging work for leveling the fields or the ground, the control lever for operating the arm b must be elaborately operated to operate the arm b simultaneously with the actions of the boom a and the bucket c. Such a mode of control of the hydraulic circuit is difficult and requires skilled control.

SUMMARY OF THE INVENTION

Accordingly, it is an object of the present invention to provide a simple hydraulic actuator control circuit facilitating the fine control of a hydraulic actuator for delicate operation as well as the control of the same for rapid operation.

To achieve the above object, the present invention provides a hydraulic actuator control circuit capable of increasing the flow rate of the working fluid supplied to a hydraulic actuator when the load on the hydraulic actuator exceeds a predetermined value. It comprises a first valve group comprising a plurality of hydraulic selector valves including pilot controlled selector valves, a second valve group comprising a logic valve and a plurality of hydraulic selector valves including pilot controlled selector valves, two hydraulic pumps connected, respectively, to the first and second valve groups, and a tank for containing the working fluid.

A two-port two-position valve is provided in a line connected to the chamber of the logic valve, normally biased by a spring to the closed position to disconnect the line connected to the chamber of the logic valve from a line leading to the tank. The two-port two-position valve is capable of being shifted to the open position by a pilot pressure applied to the pilot chamber thereof to connect the line connected to the chamber of the logic valve to the line leading to the whereby the second hydraulic pump is connected tot he actuator. A pilot controlled selector valve is biased normally by a spring to the open position to connect a line connected to the pilot chamber of the two-port two-position valve to a line leading to the tank. The pilot controlled selector valve is capable of connecting the line connected to the pilot chamber of the two-port two-position valve to an external pilot line when a pressure exceeding a predetermined value is applied to the pilot chamber thereof. A line branched from a pilot line connected to the pilot chambers of the pilot controlled selector valves of the first valve group being connected via the selector valve to a line connected to the pilot chamber of the two-port two-position valve; a line branched from a supply line for supplying the working fluid to the hydraulic selector valves of the first valve group is connected to the pilot chamber of the pilot controlled selector valve.

When a control lever is operated to apply a pilot pressure through a pilot valve to the pilot chamber of a hydraulic valve of one of the two valve groups, the working fluid discharged by one of the hydraulic pumps is applied through the selector valve to the hydraulic actuator. Since the pressure in the pilot chamber of the hydraulic selector valve is comparatively low when the load on the hydraulic actuator is comparatively small and the operating pressure of the hydraulic actuator is not more than a predetermined value, the position of the hydraulic selector valve is not changed. Accordingly, the pilot chamber of the shutoff valve is connected to the tank, and the chamber of the logic valve is disconnected from the tank by the shutoff valve. Consequently, the working fluid supplied to the other valve group is unable to flow through the logic valve.

When the load on the hydraulic actuator increases to increase the operating pressure of the hydraulic actuator beyond the predetermined value, the position of the selector valve is changed against the resilience of the spring, the branch pilot line connected to the pilot valve is connected to the pilot chamber of the shutoff valve to open the shutoff valve, so that the chamber of the logic valve is connected to the tank. Consequently, the working fluid discharged by the other hydraulic motor is supplied through the hydraulic valve of the other valve group to the supply line in addition to the working fluid supplied through the hydraulic valve of the former valve group.

Thus, only the working fluid discharged by one of the two hydraulic motors is supplied to the hydraulic actuator while the load on the hydraulic actuator is small to facilitate the fine control of the hydraulic actuator, hence the delicate operation of the hydraulic actuator and, on the other hand, the hydraulic circuit is changed over automatically to supply the working fluid discharged by both the hydraulic motors to the hydraulic actuator for the rapid operation of the hydraulic actuator, namely, for the operation of the functional member under a heavy load, when the load on the hydraulic actuator increases beyond the predetermined value.

BRIEF DESCRIPTION OF THE DRAWINGS

The above and other objects, features and advantages of the present invention will become more apparent from the following description taken in conjunction with the accompanying drawings, in which.

DETAILED DESCRIPTION OF THE PREFERRED EMBODIMENT

Figure 1:
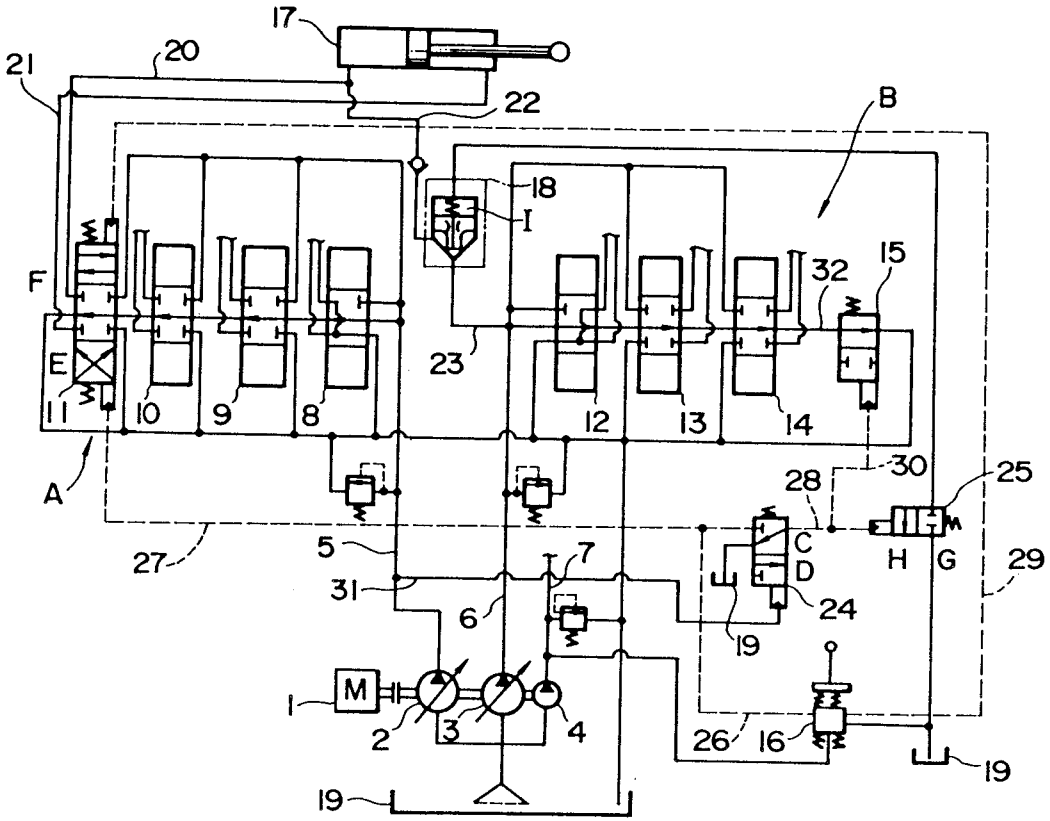
FIG. 1 is a circuit diagram of a hydraulic actuator control circuit embodying the present invention as applied to a hydraulic shovel excavator.
Figure 2:
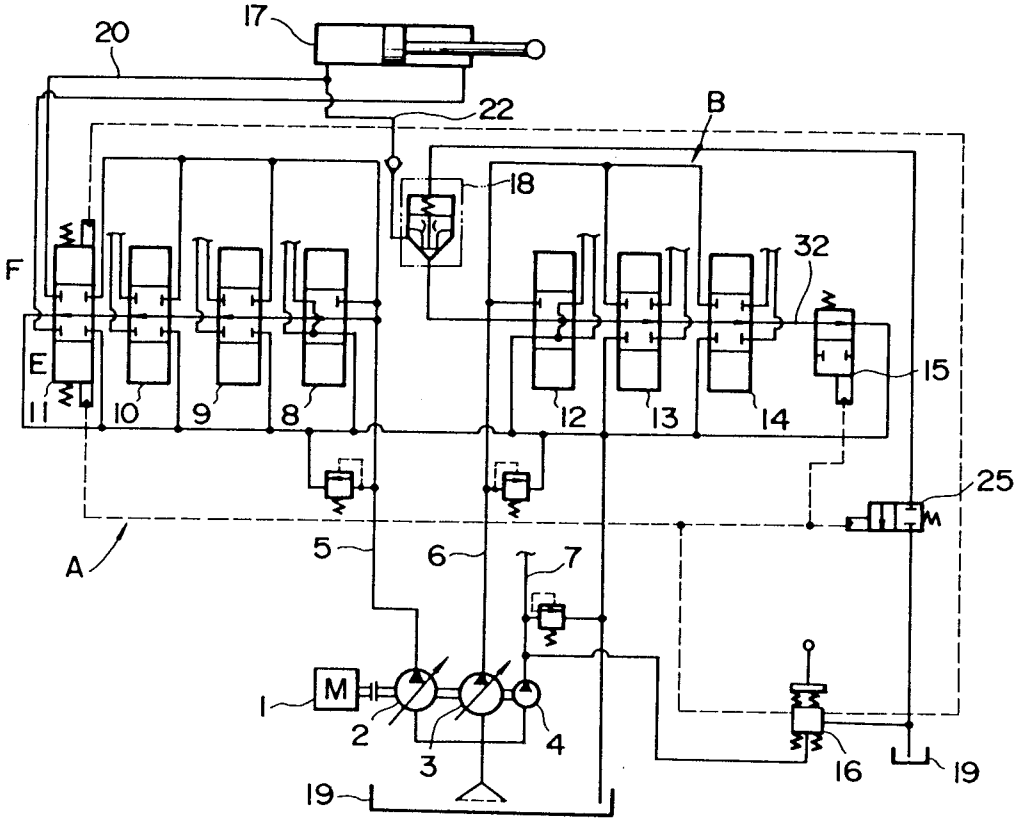
FIG. 2 PRIOR ART
FIG. 2 is a circuit diagram of a conventional hydraulic system of a hydraulic shovel excavator.
Figure 3:
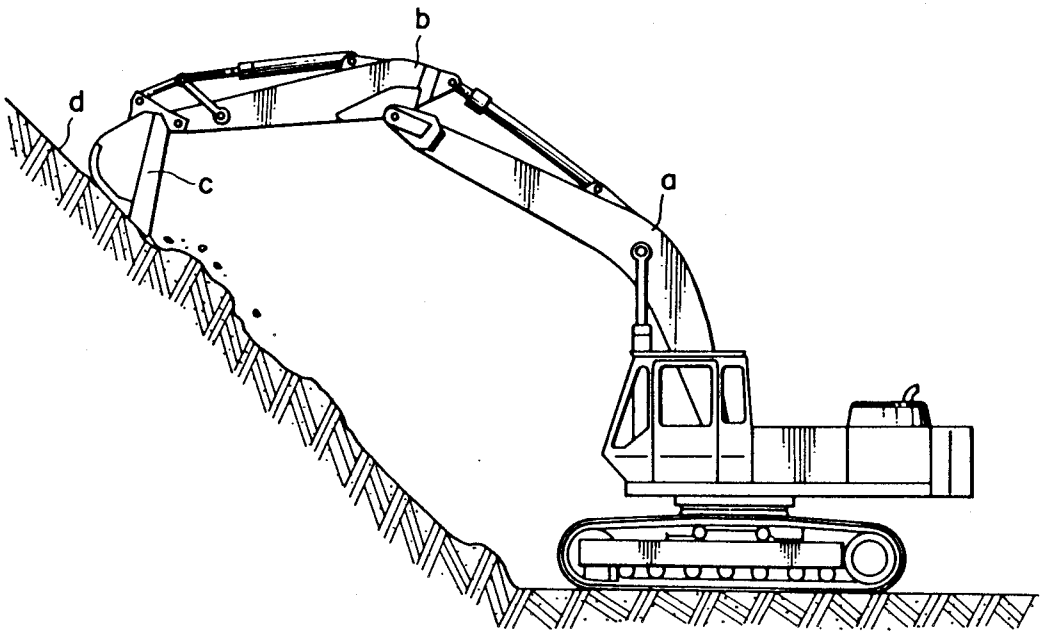
FIG. 3 is a pictorial view of a hydraulic shovel excavator in operation for finishing a side slope.

Referring to FIG. 1, a hydraulic actuator control circuit has two hydraulic pumps, namely, a first hydraulic pump 2 and a second hydraulic pump 3, individual valve groups A and B connected, respectively, to the first hydraulic pump 2 and the second hydraulic pump 3. The hydraulic pumps 2 and 3 and a pilot pump 4 are driven by an engine 1. The valve group A has hydraulic selector valves 8, 9, 10 and 11. The valve group B has hydraulic selector valves 12, 13 and 14, a two-port two-position valve 15 and a logic valve 18. The first hydraulic pump 2 supplies working fluid through a line 5 to the valve group A. The second hydraulic pump 3 supplies working fluid through a line 6 to the valve group B. All the hydraulic valves except those for controlling the running mode of the hydraulic shovel excavator are pilot controlled selector valves having pilot chambers to which is applied a pilot pressure to control the hydraulic valves. In FIG. 1, only a pilot valve 16, lines associated with the hydraulic selector valve 11 and a hydraulic actuator 17 connected to the hydraulic selector valve 11 are shown. Pilot valves, lines associated with the rest of the selector valves and hydraulic actuators connected to the rest of the hydraulic selector valves are omitted. The hydraulic selector valve 11 is connected by lines 20 and 21, respectively, to the head-side chamber and rod-side chamber of the hydraulic actuator 17.

When the chamber I of the logic valve 18 is connected suddenly to a tank 19, the logic valve 18 opens, due to the resulting pressure relief, to allow the working fluid discharged by the second hydraulic pump 3 to flow through a line 23 branched from the line 6, the logic valve 18 and a check valve into a line 22 connected to the line 20. A selector valve 24 is provided in a pilot line 28 branched from a pilot line 26 having one end connected to the pilot valve 16 and the other end connected to a pilot line 27 connected to one of the pilot chambers of the hydraulic selector valve 11. The pressure in the line 5 is applied through a line 31 to the pilot chamber of the selector valve 24. The selector valve 24 is biased in a position C by a spring when the pressure applied to the pilot chamber thereof through the line 5 is lower than a predetermined value. The selector valve is shifted to a D position to connect the pilot lines 26 to the pilot line 28 when a pressure exceeding the predetermined value is applied to the pilot chamber thereof.

A two-port two-position valve 25 is provided in a line connecting the chamber I of the logic valve 18 to the tank 19. Normally, the valve 25 is biased by a spring to a position G to intercept the flow of the working fluid therethrough. A pilot pressure is applied through the external pilot line 28 to the pilot chamber of the two-position valve 25 to shift the valve 25 to a position H, in which the chamber I of the logic valve 18 is connected to the tank 19. A pilot line 30 branched from the pilot line 28 is connected to the pilot chamber of the two-position valve 15. Normally, the two-position valve 15 is biased to an open position by a spring to connect the central bypass line 32 of the valve group B to the tank 19. When a pilot pressure is applied to the pilot chamber of the two-position valve 15, the two-position valve 15 is shifted to a closed position to intercept the flow of the working fluid therethrough. A pilot line 29 has one end connected to the pilot valve 16 and the other end connected to the pilot chamber on the side F of the hydraulic selector valve 11 to apply the pilot pressure to the same pilot chamber. The pilot pressure is applied through the line 27 to the pilot chamber on the side E of the hydraulic selector valve 11.

The operation of the hydraulic actuator control circuit thus constructed will be described hereinafter.

Suppose that a pilot pressure is produced in the lines 26 and 27 by operating the control lever of the pilot valve 16. Then, the pilot pressure acts on the pilot chamber of the hydraulic selector valve 11 to shift the hydraulic selector valve from the neutral position to the position E. Then, the working fluid discharged by the first hydraulic pump 2 and supplied to the valve group A flows through the passage in the position E of the hydraulic selector valve 11 and the line 20 into the head-side chamber of the hydraulic actuator 17 to actuate the hydraulic actuator 17. The working fluid discharged from the rod-side chamber of the hydraulic actuator 17 returns through the line 21 to the tank 19. If the load on the hydraulic actuator 17 is comparatively small, the pressure prevailing within the line 20, hence within the line 5, is comparatively low. Accordingly, a comparatively low pressure insufficient to shift the selector valve 24 is applied through the line 31 to the pilot chamber of the selector valve 24, so that the selector valve 24 remains in the position C to leave the pilot lines 28 and 30 connected to the tank 19, the two-position valve 15 remains in the open position, and the two-position valve 25 is held in the position G to keep the chamber I of the logic valve 18 at elevated pressure so that the logic valve 18 is closed. Consequently, the working fluid discharged by the second hydraulic pump 3 is unable to flow through the logic valve 18 and returns through the central bypass line 32 to the tank 19.

As the load on the hydraulic actuator 17 increases, the pressures in the lines 5, 20 and 31 increase. Upon the increase of the pressure within the line 31 beyond the predetermined value, the selector valve 24 is shifted from the position C to the position D. Consequently, the line branched from the line 26 is connected through the passage in the position D of the selector valve 24 and the pilot lines 28 and 30 to the pilot chambers of the two-position valves 15 and 25 to close the two-position valve 15 and to open the two-position valve 25, and thereby the chamber I of the logic valve 18 is connected to the tank 19 and the central bypass line 32 is shut off. Therefore, the working fluid discharged by the second hydraulic pump 3 supplied through the line 6 to the valve group B flows through the line 23 and the logic valve 18 into the line 22 connected to the line 20. Consequently, both the working fluid discharged by the first hydraulic pump 2 and the working fluid discharged by the second hydraulic pump 3 flow together into the head-side chamber of the hydraulic actuator 17 to increase the operating speed of the hydraulic actuator 17.

Suppose that the control lever of the pilot valve 16 is operated in the opposite direction. Then, the pilot pressure is applied through the line 29 to the pilot chamber on the side F of the hydraulic selector valve 11 to shift the hydraulic selector valve 11 to the position F. Consequently, the hydraulic actuator 17 is operated in the reverse direction. In this state, only the working fluid discharged by the first hydraulic pump 2 is supplied to the rod-side chamber of the hydraulic actuator 17. Therefore, the lines 20 and 21 are connected, in general, to the head-side chamber and rod-side chamber, respectively, of the hydraulic actuator 17.

Although the preferred embodiment of the present invention has been described as applied to the control of a hydraulic actuator for operating the arm of a hydraulic shovel excavator, the present invention is not limited thereto in its application. The present invention is applicable to hydraulic actuator control circuits for controlling hydraulic actuators for other purposes. The present invention may be embodied in a hydraulic actuator control circuit comprising more than two hydraulic pumps and more than two valve groups combined, respectively, with the hydraulic pumps, additional two-position valves, additional selector valve and/or additional logic valves. Each of the valve groups may comprise selector valves such as to be controlled, respectively, by different pilot pressures to enable the operating speed of the associated hydraulic actuator to be regulated automatically and optionally according to the load on the hydraulic actuator.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A hydraulic actuator control circuit capable of increasing the flow rate of a working fluid supplied to at least one hydraulic actuator, comprising:

a tank for containing the working fluid;

a first valve group comprising a plurality of hydraulic selector valves including at least one pilot controlled selector valve;

a second valve group comprising a normally closed logic valve movable to open when a chamber thereof is exposed to the pressure in the tank, and a plurality of hydraulic selector valves including at least one pilot controlled selector valve;

a first hydraulic pump connected to fluid chambers of the hydraulic actuator via the first hydraulic valve group;

a second hydraulic pump connected to the second hydraulic valve group, and connected to one of the chambers of said actuator via said logic valve when said logic valve is open;

a two-port two-position valve provided in a line connected to the chamber of the logic valve, said two-port two-position valve being normally biased to a closed position to disconnect the line connected to the chamber of the logic valve from the tank, said two-port two-position valve including means for shifting said two-port two-position valve to an open position by a pilot pressure applied to a pilot chamber thereof so as to connect the line connected to the chamber of the logic vale to the tank, whereby said second hydraulic pump is connected to said one of the chambers of said actuator; and a pilot controlled selector vale normally biased to an open position to connect the pilot chamber of the two-port two-position valve to the tank, and having means for connecting the pilot chamber of the two-port two-position valve to an external pilot line having a pilot pressure when a pressure exceeding a predetermined value is applied to a pilot chamber of said pilot controlled selector valve.

2. The circuit of claim 1 wherein said external pilot line comprises a line branched from a pilot line connected to pilot chambers of at least one of the pilot controlled selector valves of the first valve group and being connected to the selector valve.

3. The circuit of claim 2 including a lien branched from a supply line for supplying the working fluid from the first hydraulic pump to the hydraulic selector valves of the first valve group being connected to the pilot chamber of the pilot controlled selector valve.

4. The circuit of claim 1 wherein said second valve group is connected to the first valve group.

* * * * *